United States Patent [19]

Hinton et al.

[11] 4,042,900

[45] Aug. 16, 1977

[54] ELECTROSTATIC SHIELDING OF DISC WINDINGS

[75] Inventors: Reginald A. Hinton, Middlesbrough, England; Kenneth W. Doughty, Guelph, Canada; William N. Kennedy, Pittsfield, Mass.

[73] Assignee: General Electric Company

[21] Appl. No.: 627,555

[22] Filed: Oct. 31, 1975

Related U.S. Application Data

[63] Continuation of Ser. No. 475,522, June 3, 1974, abandoned.

[51] Int. Cl.[2] ..... H01F 15/04

[52] U.S. Cl. ..... 336/70; 336/84; 336/187

[58] Field of Search ..... 336/84, 69, 70, 186, 336/187

[56] References Cited

U.S. PATENT DOCUMENTS

| | | | |
|---|---|---|---|
| 2,905,911 | 9/1959 | Kurita | 336/70 |
| 3,160,838 | 12/1964 | Bedil | 336/69 |
| 3,380,007 | 4/1968 | Alverson et al. | 336/84 X |
| 3,691,494 | 9/1972 | Okuyama | 336/84 |

*Primary Examiner*—Thomas J. Kozma
*Attorney, Agent, or Firm*—Francis X. Doyle

[57] ABSTRACT

An electrostatic shielding arrangement for improving the initial distribution of voltage which in turn reduces the insulation stresses on disc-wound coils resulting from the application of impulse or steep wave-front voltages to such coils. Floating electrostatic shields are placed near or internal of the innermost or the innermost and outermost turns only of a disc coil section. Shields are connected together in pairs, with no more than one shield connection being made between adjacent coil sections.

13 Claims, 5 Drawing Figures

ELECTROSTATIC SHIELDING OF DISC WINDINGS

This is a continuation, of application Ser. No. 475,522, filed June 3, 1974, now abandoned.

BACKGROUND OF THE INVENTION

Our invention relates to electric inductive apparatus such as transformers, reactors, and the like. The invention is directed to high voltage coils of the disc winding type and particularly to the use of electrostatic shields in such coils for improving the voltage distribution and thereby reducing the insulation stresses created by the application of steep wave front or impulse voltages to those disc winding type coils.

It is well known that highly inductive windings such as iron core transformer and reactor windings, when exposed to steep wave front or surge voltages, initially exhibit an expotential distribution of voltage drop along the length of the coil winding with a very high voltage gradient at the first few turns adjacent the line terminal or high voltage end of the coil. This non-uniform distribution of surge voltages or potentials is undesirable, as it necessitates thicker insulation between the conductor turns of the coils, and thicker insulation between the first few coil sections adjacent the line terminal. Size and cost of electrical inductive apparatus is thus adversely affected. Merely increasing the thickness of electrical insulation does not insure that the winding will not fail when subjected to surge potentials, as increasing the thickness of the electrical insulation reduces the internal or series capacitance of the turns and coil sections at the line end, which causes a still more unfavorable distribution of surge potential. This condition arises because the winding presents an impedance which is predominantly capacitive to steep wave front voltages. Such capacitive impedance is made up of a complex network of capacitances in series and parallel circuit relation. If series capacitance only were present, voltage distribution throughout the winding would be substantially uniform and linear. The initial impulse voltage distribution of a transformer winding grounded at one end is given by the relation:

$$V = V_o \frac{\sinh \alpha (1 - X)}{\sinh \alpha}$$

where $V_o$ = Voltage applied to high potential terminal of coil winding.

X = Percent distance along winding from line end.

$$\alpha = \sqrt{\frac{C_g}{C_s}}$$

$C_g$ = Total capacitance between the winding and ground plane.

and $C_S$ = Total series capacitance of the winding.

This initial distribution is shown in FIG. 1. It can be seen from this figure that the voltage stress at the impulsed or line end of the coil, as represented by the curved line designated initial impulse voltage distribution, is greater than the steady state voltage distribution given by the straight line designated final distribution. It can be shown that this increase in stress is directly proportional to "$\alpha$". It is therefore possible to lower this initial stress by reducing "60", which can be accomplished by increasing $C_S$. It is therefore desirable to construct a winding in such a way that the series capacitance is large relative to the parallel or ground capacitance in the disc/coil winding.

Various electrostatic shielding arrangements have been utilized in the past in an attempt to increase the series capacitance in order to improve the initial distribution of an impulse voltage applied to coils of the aforementioned type. These arrangements have met with varying degrees of success and have resulted in either less than adequate performance or an unavoidable increase in coil size and/or cost. One arrangement illustrated in U.S. Pat. No. 2,905,911 to KURITA involves, in one embodiment thereof, the placing of uninsulated shield conductors between at least the two outermost conductor turns of each disc coil layer or coil section and then the connecting together of these shield conductors to form floating shield pairs. While this improves the initial impulse voltage distribution along the outside of the coil winding it does very little to improve the initial voltage distribution along the inside of the coil winding. Another arrangement illustrated in U.S. Pat. No. 3,380,007 to ALVERSON et al, involves in one embodiment thereof, the placement of shield conductors between the two outermost and the two innermost turns of each disc coil layer or coil section. The shields are connected in pairs, alternately along the inside and the outside of the coil windings, to the current carrying conductor at the opposite end of the disc coil section in which said shield is located, said connections to the current carrying conductors causing an undesirable increase in coil size and cost.

In order to avoid these and other disadvantages it would be desirable to provide an electrostatic shielding arrangement that would improve the initial distribution of impulse voltage applied to coil windings having serially connected disc type coil sections and in addition, reduce both the size and cost of adding such a shielding arrangement to such coils.

Accordingly, it is the principal object of the present invention to provide an electrostatic shielding arrangement that will improve the initial distribution of impulse voltage applied to coil windings having serially connected disc type coil sections.

Another object of the present invention is to provide an electrostatic shielding arrangement for disc type coil windings that will contribute a minimum increase to overall coil size.

A further object of the present invention is to provide an electrostatic shielding arrangement for disc type coil windings that will add a minimum amount of cost to the construction of such coils.

SUMMARY OF THE INVENTION

When windings having disc type layers or coil sections are exposed to a steep wave front voltage a disproportionately large amount of said voltage appears across the first few turns of said coil. This non-uniform distribution of voltage necessitates the use of thicker insulation between conductor turns and between the first few coil sections. To cope with this problem, an electrostatic shielding arrangement has been devised capable of producing a near uniform distribution of impulse voltages when applied to such coils.

In one embodiment floating shields are placed adjacent or internal of the innermost turn only of each coil section. Shields in adjacent coil sections are connected together in pairs near the internal ends of adjacent coil sections having the greatest potential difference between coil conductor turns, when energizing, in adjacent coil sections. The remaining shield in the initial disc layer or section at the high voltage end of the winding is connected to the steep wave front voltage source.

In another embodiment floating shields are placed adjacent to or internal of both the innermost and the outermost turns only of a coil section with only one shield connection being made between coil sections, alternately at one end and then the other end of adjacent coil sections. Shields in adjacent coil sections are connected together in pairs near the ends of adjacent coil sections having the greatest potential difference between coil conductor turns, when energized, in adjacent coil sections. A shield in the initial coil section, at the high voltage end of the coil is connected to the steep wave-front voltage source.

The invention, which is sought to be protected, will be particularly pointed out and distinctly claimed in the claims appended thereto. However, it is believed that this invention and the manner in which its objects and advantages are obtained, as well as other objects and advantages thereof, will be more readily understood by reference to the following detailed descriptions of the preferred embodiments thereof particularly when considered in light of the accompanying drawings.

DESCRIPTION OF THE PREFERRED EMBODIMENTS

First Embodiment

Figure 2:
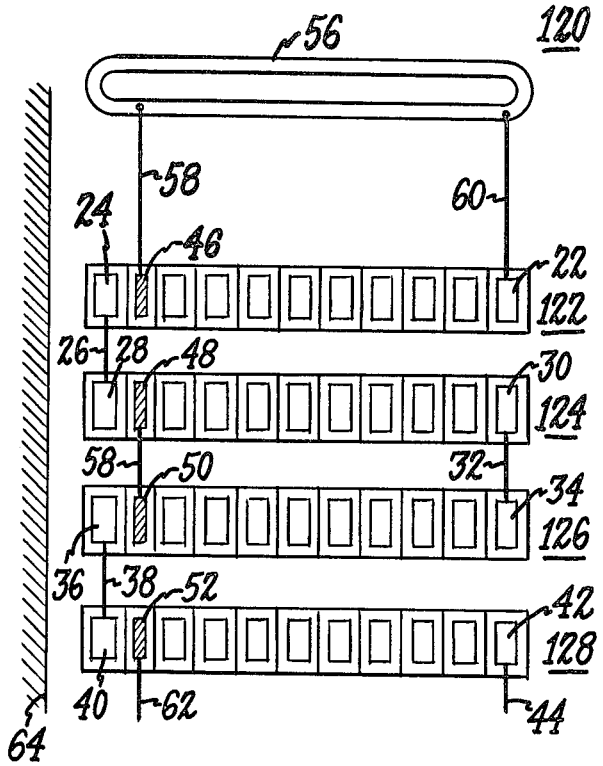
FIG. 2 is a diagrammatic sectional view taken on a radial plane of a single strand annular coil illustrating an embodiment of our invention.

Referring now to the drawings wherein like numerals are used to indicate like parts throughout, in FIG. 2 a diagrammatic sectional view taken on a radial plane of a single strand spirally wound annular disc coil 120 incorporating an embodiment of our invention is illustrated. Annular coil 120 is comprised of, from top to bottom, concentrically stacked annular disc layers or coil sections 122, 124, 126 and 128 respectively constructed of insulated conductor turns. Beginning with outermost turn 22, coil section 122 is spirally wound inward to innermost turn 24. An electrical connection 26 is made between innermost turn 24 on coil section 122 and innermost turn 28 on adjacent coil section 124. Beginning with turn 28, coil section 124 is spirally wound outward to outermost turn 30. An electrical connection 32 is made from outermost turn 30 of coil section 124 to outermost turn 34 of coil section 126. Beginning with outermost turn 34, coil section 126 is spirally wound inward, terminating with innermost turn 36. An electrical connection 38 is made from innermost turn 36 of coil section 126 to innermost turn 40 of coil section 128. Beginning with said innermost turn 40, coil section 128 is spirally wound outward terminating with outermost turn 42 of said coil section 128. Additional coil sections, if necessary, are connected to electrical connection 44 in the same manner as the previously described coil sections. If no further coil sections are to be added, electrical connection 44, or the equivalent, is tied to neutral or ground potential.

A single insulated shield-conductor in the form of a thin copper strip is wound between the two innermost turns of each coil section. Shield-conductors 46, 48, 50, and 52 are wound between the two innermost turns of coil sections 122, 124, 126 and 128 respectively.

It is well known in the art to place an insulated metallic covered plate, such as static plate 56, adjacent the high potential end of a disc type coil, such as coil 120. Static plate 56 aids in distributing an impulse voltage applied to disc coil 120 more evenly throughout the high potential end of said coil 120.

Electrical connections are made from shield-conductor 46 and outermost turn 22 of coil section 122 to static plate 56 by electrical connections 58 and 60 respectively. Excluding shield-conductor 46 in coil section 122, the remaining adjacent shield conductors are connected together in pairs. Specifically, shield conductor 48 in coil section 124 is connected to adjacent shield conductor 50 in coil section 126 only, by electrical connection 58. Shield conductor 52 would be connected to a similarly positioned shield in an adjacent coil section (now shown) by electrical connection 62 if another coil section were utilized. If coil section 128 is the final coil section or the coil section that is furthest away from the high potential end of coil 120, shield conductor 52 would not be provided in said coil section 128. Ground plane 64 is the plane to which voltages in coil 120 are referenced.

Except for shield conductor 46 in coil section 122, the electrostatic shields utilized in coil 120 are arranged along the inside thereof and are electrically floating. In other words, shield conductors 48, 50, and 52 are capacitively coupled only to the current carrying conductor turns of coil 120. There are no electrical connections between said shield conductors 48, 50 and 52 and a non-shield i.e., a coil current carrying conductor.

In coils of the type described herein it is customary design practice, particularly in coils required to carry large currents, to construct such coils of conductor turns consisting of two or more insulated strands. By utilizing turns having insulated strands, power loss from local circulating or eddy currents is greatly reduced. The winding arrangement in FIG. 3 will describe the manner in which electrostatic shields are placed between strands of a stranded turn, spirally wound, disc section coil and the advantages obtained by such placement.

Figure 3:
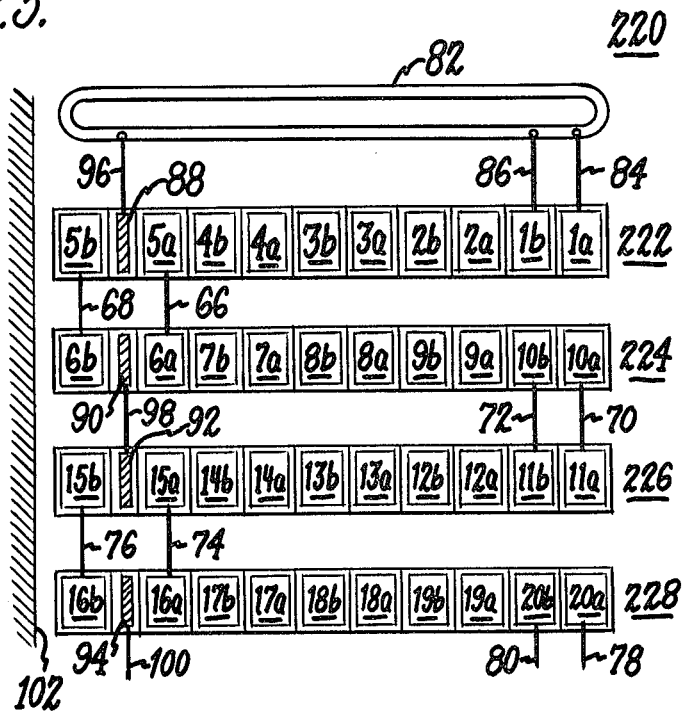
FIG. 3 is a diagrammatic sectional view taken on a radial plane of a multiple strand annular coil illustrating an embodiment of our invention.

Reference should here be made to FIG. 3 which is a diagrammatic sectional view taken on a radial plane of a multiple strand, spirally would disc section coil incorporating an electrostatic shield in a manner somewhat similar to that illustrated in FIG. 2. Annular coil 220 is comprised of, from top to bottom, concentrically stacked annular coil sections 222, 224, 226 and 228 respectively. Beginning with the outermost turn of coil section 222, consisting of juxtaposed strands **1*a* and 1*b*, said coil section 222 is wound spirally inward to the innermost turn which consists of juxtaposed strands 5*a*** to 5*b*. Adjacent coil section 224 is spirally wound outward beginning with the innermost turn consisting of juxtaposed strands 6*a* and 6*b* and terminating with juxtaposed strands 10*a* and 10*b* of the outermost turn of coil section 224. Strands 5*a* and 5*b* of coil section 222 are electrically connected to strands 6*a* and 6*b* of coil section 224 by electrical connections 66 and 68 respectively. Coil section 226 adjacent coil section 224 is spirally wound inward beginning with juxtaposed strands 11*a* and 11*b* of the outermost turn and terminating with juxtaposed strands 15*a* and 15*b* of the innermost turn. Coil section 228, adjacent coil section 226 is spirally wound outward beginning with juxtaposed strands 16*a* and 16*b* of the innermost turn and terminating with juxtaposed strands 20*a* and 20*b* of the outermost turn. Strand 10*a* and 10*b* of coil section 224 are connected to strands 11*a* and 11*b* of coil section 226 by electrical connections 70 and 72 respectively. Strands 15*a* and 15*b* of coil section 226 are electrically connected to strands 16*a* and 16*b* of coil section 228 by electrical connections 74 and 76 respectively. Additional coil sections, if any, are connected to electrical connections 78 and 80 in the same manner as the previously described coil sections. If no further coil sections are to be added, electrical connections 78 and 80, or the equivalent thereof, are tied to a neutral point or ground potential. Strands 1*a* and 1*b* of coil section 222 are connected to static plate 82 by electrical connections 84 and 86.

A single insulated shield conductor turn in the form of a thin copper strip is wound between the strands of or internal of the innermost turn of each coil section. Shield turns 88, 90, 92 and 94 are wound between strands 5*a* and 5*b*, 6*a* and 6*b*, 15*a* and 15*b*, 16*a* and 16*b*, respectively. Shield conductor 88 is electrically connected to static plate 82 by electrical connection 96. Shield conductors 90 and 92 are connected together by electrical connection 98. Shield connector 94 would be connected to a similarly positioned shield in an adjacent coil section (not shown) by electrical connection 100 if another coil section were utilized. If coil section 228 is the final section or the coil section that is furthest away from the high potential end of coil 220, shield conductor turn 94 would not be provided in said coil section 228. Ground plane 102 is the plane to which voltages in coil 220 are referenced.

Except for shield conductor turn 88 in coil section 222, the shields arranged along the inside of coil 220 are electrically floating with respect to the non-shield or the coil current carrying conductor of said coil 220 in the same manner as the shields in the previously described coil 120.

With the foregoing shield arrangement as above described and as illustrated in FIGS. 2 and 3, the initial distribution of an impulse or step voltage applied to coils 120 or 220 is determined primarily by the arrangement of the aforementioned floating shields along the inside of said coils 120 and 220. The increased series capacitance introduced into coils 120 and 220 by these floating shields is much larger than the shunt capacitance of said coils 120 and 220 to ground. Consequently, the initial impulse voltage distribution or the initial impulse voltage division along the inside of coils 120 and 220 is directly proportional to the series capacitance introduced by the aforementioned floating shields; said distribution being almost linear along the conductor length of said coils 120 and 220.

Second Embodiment

Figure 4:
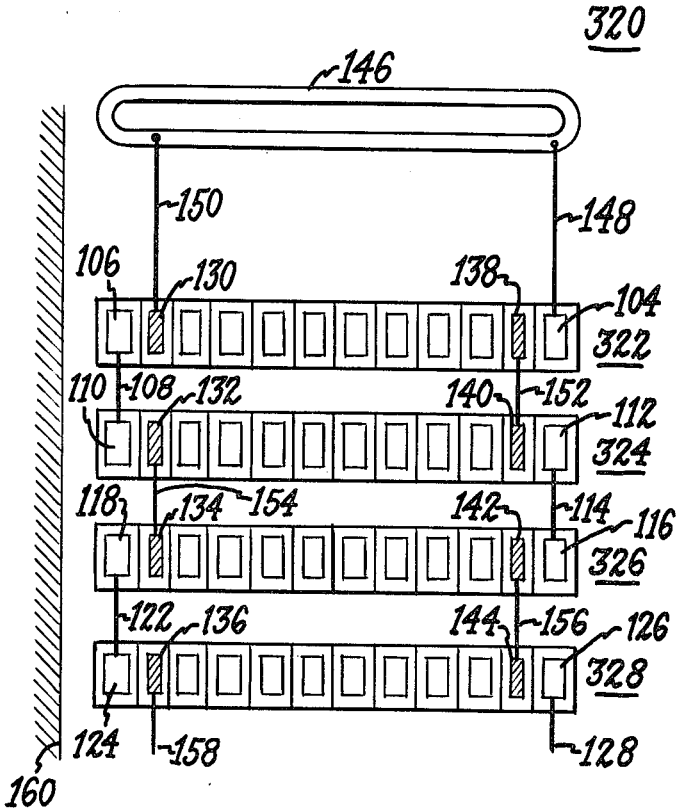
FIG. 4 is a diagrammatic sectional view of a single strand annular coil similar to FIG. 2 illustrating a modified embodiment of our invention.

Referring here to FIG. 4 which is a diagrammatic sectional view taken on a radial plane of single strand, spirally wound, disc section coil 320 incorporating a modified embodiment of our invention. Annular coil 320 is comprised of, from top to bottom, concentrically stacked annular disc layers or coil sections 322, 324, 326 and 328 respectively. Beginning with outer turn 104, coil section 320 is spirally wound inward to innermost turn 106. Electrical connection 108 is made between innermost turn 106 on coil section 322 and innermost turn 110 on adjacent coil section 324. Beginning with turn 110, coil section 324 is spirally wound outward to turn 112. Electrical connection 114 is made from outermost turn 112 of coil section 324 to outermost turn 116 of coil section 326. Beginning with outermost turn 116, coil section 326 is spirally wound inward, terminating with turn 118. Electrical connection 122 is made from innermost turn 118 of coil section 326 to innermost turn 124 of coil section 328. Beginning with innermost turn 124, coil section 128 is spirally wound outward terminating with outermost turn 126. Additional coil sections are connected to electrical connection 128 in the same manner as the previously described coil sections. If no further coil sections are to be added, electrical connection 128, or the equivalent thereof is connected to neutral or ground potential.

A single insulated shield conductor in the form of a thin copper strip is wound between the two innermost turns and the two outermost turns of each coil section. Shield- conductors 130, 132, 134 and 136 are wound between the two innermost turns of coil sections 322, 324, 326 and 328 respectively. Shield-conductors 138, 140, 142 and 144 are wound between the two outermost turns of coil sections 322, 324, 326 and 328 respectively.

Electrical connections are made from outermost turn 104 and shield-conductor 130 of coil section 322 to static plate 146 by electrical connections 148 and 150 respectively. Excluding shield-conductors 130 in coil section 322, adjacent shield-conductors are connected together in pairs with only one shield connection being made between adjacent coil sections. Specifically shield-conductor 138 in coil section 322 is connected to adjacent shield-conductor 140 in coil section 324 only, by electrical connection 152. Shield-conductor 132 in coil section 324 is connected to adjacent shield-conductor 134 in coil section 326 only, by electrical connection 154. Shield-conductor turn 142 in coil section 326 is connected to adjacent shield-conductor 144 in coil section 328 only, by electrical connection 156. Shield-conductor 136 is coil section 328 would be connected to a similarly positioned shield in an adjacent coil section (not shown) by electrical connection 158. If coil section 328 is the final coil section of coil 320, shield-conductor 136 would not be provided in said coil section 328. Except for shield-conductor turn 130 in coil section 322, the shields arranged along the inside and outside of coil 320 are floating or are insulated from the coil current carrying conductor of said coil 320. Ground plane 160 is the plane to which voltages in coil 320 are referenced.

Figure 5:
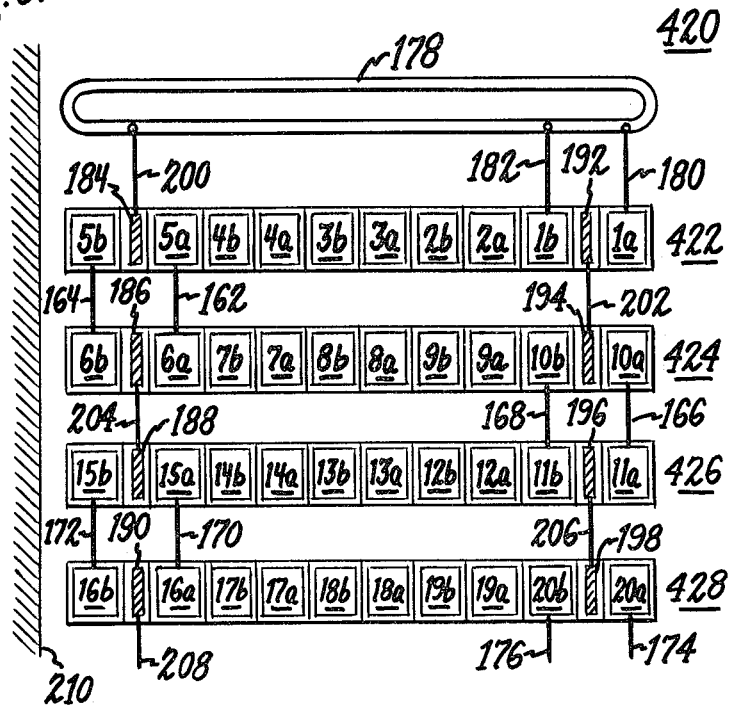
FIG. 5 is a diagrammatic sectional view of a multiple strand annular coil, similar to FIG. 3, illustrating a modified embodiment of our invention.

Reference should here be made to FIG. 5 which is a diagrammatic sectional view taken on a radial plane of multiple strand, spirally wound, disc section coil 420 incorporating a modified embodiment of our invention. Annular coil 420 is comprised of, from top to bottom, concentrically stacked annular coil sections 422, 424, 426 and 428. Beginning with the outermost turn of coil section 422, consisting of juxtaposed strands 1*a* and 1*b*, said coil section 422 is wound spirally inward to the innermost turn which consists of juxtaposed strands 5*a* and 5*b*. Adjacent coil section 424 is spirally wound outward beginning with the innermost turn consisting of juxtaposed strands 6*a* and 6*b* and terminating with juxtaposed strands 10*a* and 10*b* of the outermost turn of coil section 424. Strans 5*a* and 5*b* of coil section 422 are electrically connected to strand 6*a* and 6*b* of coil section 424 by electrical connections 162 and 164 respectively. Coil section 426 adjacent disc section 424 is spirally wound inward beginning with juxtaposed strands 11*a* and 11*b* of the outermost turn and terminating with juxtaposed strands 15*a* and 15*b* of the innermost turns. Coil section 428, adjacent coil section 426, is spirally wound outward beginning with juxtaposed strands 16*a* and 16*b* of the innermost turn and terminating with juxtaposed strands 20*a* and 20*b* of the outermost turn. Strands 10*a* and 10*b* of coil section 424 are connected to strands 11*a* and 11*b* of coil section 426 respectively by electrical connections 166 and 168 respectively. Strands 15*a* and 15*b* of coil section 426 are electrically connected to strands 16*a* and 16*b* of coil section 428 by electrical connections 170 and 172 respectively. Additional coil sections, if any, are connected to electrical connections 174 and 176 in the same manner as the previously described coil sections. If no further coil sections are to be added, electrical connections 174 and 176, or the equivalent thereof, are connected to neutral or ground potential. Strands 1*a* and 1*b* of coil section 422 are connected to static plate 178 by electrical connections 180 and 182.

A single insulated shield conductor in the form of a thin copper strip is wound between the strands of or internal of the innermost and outermost turns of each coil section. Shield-conductors 184, 186, 188 and 190 are wound between strands 5*a* and 5*b*, 6*a* and 6*b*, 15*a* and 15*b* and 16*a* and 16*b* respectively. Shield-conductors 192, 194, 196 and 198 are wound between strands 1*a* and 1*b*, 10*a* and 10*b*, 11*a* and 11*b*, and 20*a* and 20*b* respectively. Shield-conductor 184 is electrically connected to static plate 178 by electrical connection 200. Shield conductors 192 and 194 are connected together by electrical connection 202 only. Shield-conductors 186 and 188 are connected together by electrical connection 204 only. Shield conductors 196 and 198 are connected together by electrical connection 206 only. Shield-conductor 190 would be connected to a similarly positioned shield in an adjacent coil section (not shown) by electrical connection 208 if another coil section were utilized. If coil section 428 is the final disc section, shield-conductor 190 would not be provided in said coil section 428. Ground plane 210 is the reference plane to which voltages in coil 420 are referenced.

With the foregoing shield arrangement as described in this second embodiment as illustrated in FIGS. 4 and 5, the initial distribution of an impulse or of a step function voltage applied to coils 320 and 420 is determined primarily by the arrangement of the aforementioned floating shields along both the inside and outside of said coils 320 and 420. The aforementioned inner and outer shields in coils 320 and 420 increase the series capacitance to a value significantly greater than the shunt or parallel coil capacitance to ground. Consequently, the initial voltage distribution of an impulse or step function voltage applied to coils 320 and 420 is along the inside and the outside of said coils 320 and 420 and said distribution is directly proportional to the series capacitance introduced by the aforementioned inner and outer electrostatic shields; said distribution being almost linear.

GENERAL CONSIDERATIONS

As can be seen from the foregoing descriptions, when electrical connections are made between shield-conductors in adjacent coil sections said connections, when made, are always made between the ends of coil sections having the greatest potential difference.

Although it appears that the inner or both the inner and outer shields must extend the entire axial length of the disc coil, such is not the case. There is an axial point, spaced from the high potential end of a coil, where the increase in coil size or cost of same outweighs the beneficial effects that additional shields might contribute. Use of shields beyond this point would be inappropriate.

Table I below gives the calculated initial voltage distribution in terms of "$\alpha$" for a typical disc section coil to show the relative effects on the initial impulse voltage distribution of such coils for various electrostatic shielding arrangements. The greater the value of "$\alpha$" the greater the electrical stress on the insulation at the high potential end of the disc coil.

Table 1

| Position of Floating Shields | "$\alpha$" |
|---|---|
| None | 6.3 |
| Along Outside | 5.8 |
| Along Inside | 3.2 |
| Along Both | 2.6 |

Figure 1:
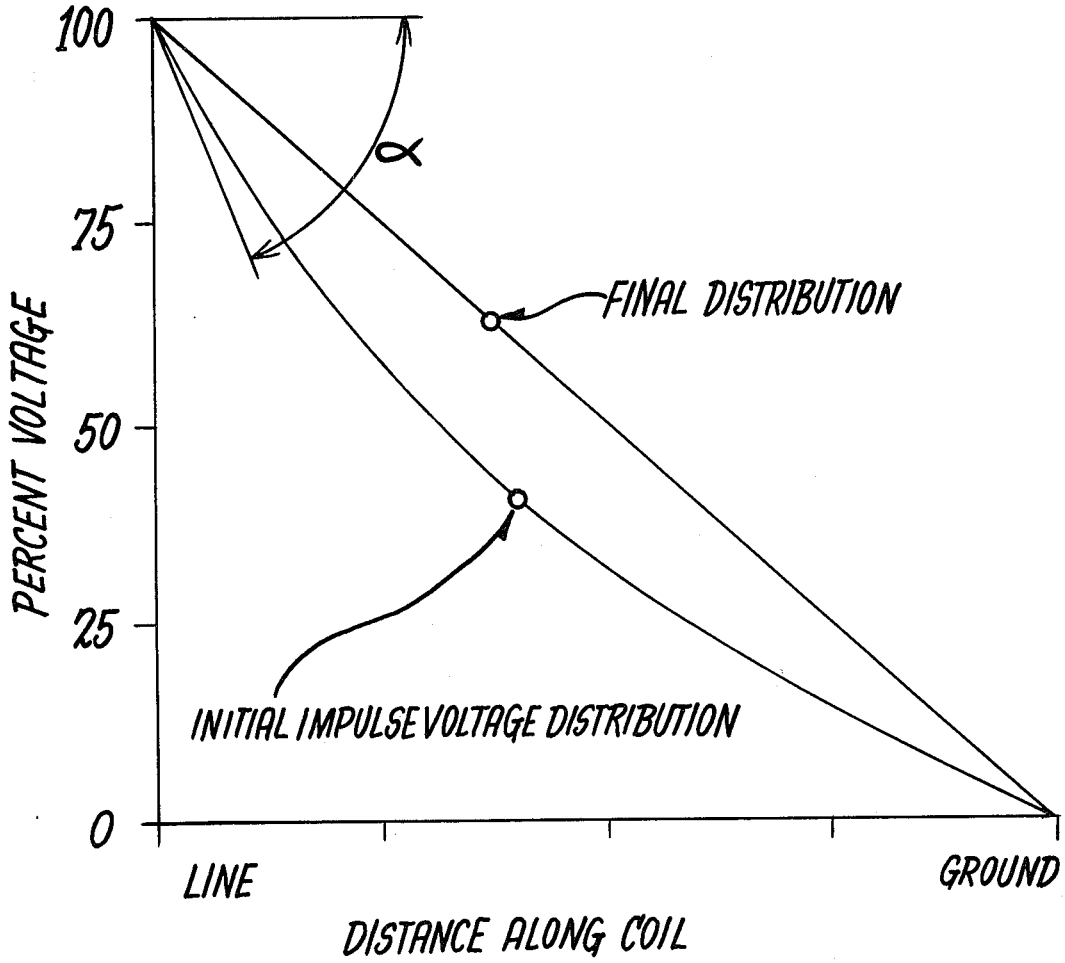
FIG. 1 is a graph of the initial and final impulse voltage distribution for a disc wound coil grounded at one end as a function of the distance along the coil winding.

The quantity "$\alpha$" is the same "$\alpha$" that has previously been defined for the mathematical relation that expresses the initial impulse voltage distribution of a transformer winding grounded at one end. The quantity "$\alpha$" is graphically depicted in FIG. 1 also. As can be seen from Table I the initial voltage distribution of a disc section, spirally wound coil employing electrostatic shields along the inside or both the inside and outside is closer to the straight line or final voltage distribution illustrated in FIG. 1 than coils having no shields or shields along the outside only. The application of shields along both the inside and the outside gives some additional improvement in the initial voltage distribution over inside shields only. The addition of outside shields essentially adds another voltage-divider circuit in parallel with the one on the inside provided by the internal shields. Both the inside and the outside electrostatic shields reinforce each other and the initial impulse voltage distribution is improved.

Although thin insulated copper strips have been employed to describe the electrostatic shields of the preferred embodiments, such a shield design is not essential in carrying out our invention. Design considerations may dictate variations in shield-conductor cross sectional area, material or the use or non-use of insulation on said electrostatic shields. Aluminum, for example, can very easily be substituted for copper. These variations and use or non-use of insulation are not material to the practicing of our invention.

Whether or not a particular coil section is spirally wound inward or outward is determined solely by the direction in which the initial coil section at the high potential end of a coil is wound if such coils are wound from the high potential to the low potential end. In coils 120, 220, 320 and 420 the initial coil sections are spirally wound inward with the remaining coil sections being wound alternately outward and inward throughout the length of these coils. Our invention is equally applicable to a coil that has the initial coil section spirally wound outward and then alternates the winding direction of the remaining coil sections throughout the length of the coil.

It will be apparent to those skilled in the art from the foregoing description of our invention that various improvements and modifications can be made in it without departing from the true scope of the invention. Accordingly, it is our intention to encompass within the scope of the appended claims the true limits and spirit of our invention.

We claim:

1. An electrostatic shielding device for inductive apparatus of the type having, a coil, including a plurality of generally coaxially disposed annular disc coil sections, each of said coil sections having a plurality of single strand insulated conductor turns;

spirally wound, in the same direction, alternately radially outward and radially inward, beginning with an initial coil section at one end of said coil and terminating with a final coil section, a finish-end of a coil section being connected to the start-end of an immediately adjacent coil section to form a coil connected in an electrical series circuit relation, the start-end of the initial coil section being for connection to a high potential source and the finish-end of the final coil section being for connection to a low potential point, wherein the improvement comprises:

an electrostatic shield-conductor between the two innermost turns only of coil sections of said coil, the shield-conductor in said initial coil section being for connection to said high potential source, a shield-conductor in one coil section being electrically connected to a correspondingly positioned shield-conductor in an immediately adjacent coil section only, said shield connections being made between the ends of adjacent coil sections having the greatest potential difference between coil section ends.

2. An electrostatic shield device for inductive apparatus as defined in claim 1 wherein a static plate is connected in electrical series with said high potential source and said coil, said static plate is located immediately adjacent an outer surface of said initial coil section to more uniformly distribute voltages appearing at a high potential end of said coil.

3. An electrostatic shielding device for inductive apparatus as defined in claim 1 wherein said shield-conductors are formed of thin copper strips of generally rectangular cross-section.

4. An electrostatic shielding device for inductive apparatus of the type having, a coil, including a plurality of generally coaxially disposed annular disc coil sections, each of said coil sections having a plurality of single strand insulated conductor turns;

spirally wound, in the same direction, alternately radially outward and radially inward, beginning with an initial coil section at one end of said coil and terminating with a final coil section, a finish-end of a coil section being connected to the start-end of an immediately adjacent coil section to form a coil connected in an electrical series circuit relation, the start-end of the initial coil section being for connection to a high potential source and the finish-end of the final coil section being for connection to a low potential point, wherein the improvement comprises:

an electrostatic shield-conductor between the two outermost and the two innermost conductor turns only of coil sections of said coil, a shield conductor at one end of a coil section being connected to the correspondingly positioned shield-conductor only, in an immediately adjacent coil section, with only one shield connection being made between adjacent coil sections, said shield connections being made between the ends of adjacent coil sections having the greatest potential difference, the remaining shield in said initial coil section being for connection to said high potential source.

5. An electrostatic shielding device for inductive apparatus as defined in claim 4 wherein a static plate is connected in electrical series with said high potential source and said coil, said static plate being located immediately adjacent an outer surface of said initial coil section to more uniformly distribute the electrical potential appearing at a high potential end of said coil.

6. An electrostatic shielding device for inductive apparatus as defined in claim 4 wherein said shield-conductors are formed of thin copper strips of generally rectangular cross-section.

7. An electrostatic shielding device for inductive apparatus of the type having, a coil, including a plurality of generally coaxially disposed annular disc coil sections, each of said coil sections having a plurality of conductor turns, each turn including a plurality of insulated strands;

spirally wound, in the same direction, alternately radially outward and radially inward, beginning with an initial coil section at one end of said coil and terminating with a final coil section, a finish-end of a coil section being connected to the start-end of an immediately adjacent coil section to form a coil connected in an electrical series circuit relation, the start-end of the initial coil section being for connection to a high potential source and the finish-end of the final coil section being for connection to a low potential point;

wherein the improvement comprises:

an electrostatic shield-conductor between said insulated strands of the innermost turn only, of coil sections of said coil, the shield-conductor in said initial coil section being for connection to said high potential source, a shield-conductor in one coil section being electrically connected to a correspondingly positioned shield-conductor in an immediately adjacent coil section only, said shield connections being made between the ends of adjacent coil sections having the greatest potential difference between coil section ends.

8. An electrostatic shielding device for inductive apparatus as defined in claim 7 wherein a static plate is connected in electrical series with said high potential source and said coil, said static plate being located immediately adjacent an outer surface of said initial coil section to more uniformly distribute a transient electrical voltage appearing at a high potential end of said coil.

9. An electrostatic shielding device for inductive apparatus as defined in claim 7 wherein said shield-conductors are formed of thin copper strips of generally rectangular cross-section.

10. An electrostatic shielding device for inductive apparatus of the type having, a coil, including a plurality of generally coaxially disposed annular disc coil sections, each of said coil sections having a plurality of conductor turns, each turn including a plurality of insulated strands;

spirally wound, in the same direction, alternately radially outward and radially inward, beginning with an initial coil section at one end of said coil, and terminating with a final coil section, a finish-end of a coil section being connected to the start-end of an immediately adjacent coil section to form a coil connected in an electrical series circuit relation, the start-end of the initial coil section being for connection to a high potential source and the finish-end of the final coil section being for connection to a low potential point, wherein the improvement comprises:

an electrostatic shield-conductor between said insulated strands of the two outermost and the two innermost turns only of coil sections of said coil, a shield-conductor at one end of a coil section being connected to the correspondingly positioned shield conductor only, in an immediately adjacent coil section, with only one shield connection being made between adjacent coil sections, said shield connections being made between the ends of adjacent coil sections having the greatest potential difference, the remaining shield in said initial coil section being for connection to said high potential source.

11. An electrostatic shield device for inductive apparatus as defined in claim 10 wherein a static plate is connected in electrical series with said high potential source and said coil, said static plate being located immediately adjacent an outer surface of said initial coil section to more uniformly distribute voltage surges appearing a a high potential end of said coil.

12. An electrostatic shielding device for inductive apparatus as defined in claim 10 wherein said shield-conductors are formed of thin copper strips of generally rectangular cross-section.

13. An electrostatic shielding device for inductive apparatus of the type having, a coil, including a plurality of generally coaxially disposed annular disc coil sections, each of said coil sections having a plurality of insulated conductor turns;

spirally wound, in the same direction, alternately radially outward and radially inward, beginning with an initial coil section at one end of said coil and terminating with a final coil section, a finish-end of a coil section being connected to the start-end of an immediately adjacent coil section to form a coil connected in an electrical series circuit relation, the start-end of the initial coil section being for connection to a high potential source and the finish-end of the final coil section being for connection to a low potential point, wherein the improvement comprises:

an electrostatic shield-conductor between an innermost portion of an innermost turn and the immediately adjacent turn only of a coil section, the shield-conductor in said initial coil section being for connection to said high potential source, a shield-conductor in one coil section being electrically connected to a correspondingly positioned shield-conductor in an immediately adjacent coil section only, said shield connections being made between the ends of adjacent coil sections having the greatest potential difference.

* * * * *

UNITED STATES PATENT OFFICE
CERTIFICATE OF CORRECTION

PATENT NO. : 4,042,900

DATED : August 16, 1977

INVENTOR(S) : Reginald A. Hinton, Kenneth W. Doughty, William N. Kennedy

It is certified that error appears in the above-identified patent and that said Letters Patent are hereby corrected as shown below:

Column 1, line 15 - "those" should be -these-

Column 1, line 68 - "60" should be -"α"-

Column 2, line 29 - "curr-" should be -cur--

Column 4, line 32 - "now" should be -not-

Column 5, line 1 - "to" should be -and-

Column 6, line 21 - after "with" and before "innermost" insert -said-

Column 6, line 52 - "is" should be -in-

Column 7, line 8 - "Strans" should be -Strands-

Column 11, line 15 - "he" should be -the-

Column 12, line 3 - the first "a" should be -at-

Signed and Sealed this

*Twenty-sixth* Day of *September 197*

[SEAL]

*Attest:*

RUTH C. MASON
*Attesting Officer*

DONALD W. BANNER
*Commissioner of Patents and Trademark*